US006988853B1

(12) United States Patent
Kuntz

(10) Patent No.: US 6,988,853 B1
(45) Date of Patent: Jan. 24, 2006

(54) MUTED TIDAL REGULATOR

(75) Inventor: Leo Kuntz, Nehalem, OR (US)

(73) Assignee: Nehalem Marine Manufacturing, Nehalem, OR (US)

( * ) Notice: Subject to any disclaimer, the term of this patent is extended or adjusted under 35 U.S.C. 154(b) by 0 days.

(21) Appl. No.: 10/982,234

(22) Filed: Nov. 4, 2004

(51) Int. Cl.
*E02B 7/40* (2006.01)

(52) U.S. Cl. ..... 405/96; 405/80; 405/81

(58) Field of Classification Search ..... 405/15, 405/52, 80, 87, 92, 94, 96
See application file for complete search history.

(56) References Cited

U.S. PATENT DOCUMENTS 3,733,830 A * 5/1973 Jacobs ..... 405/73
3,974,654 A * 8/1976 Mirto, Jr. ..... 405/127
4,091,624 A * 5/1978 Steinke ..... 405/96
4,324,506 A 4/1982 Steinke ..... 405/96
5,336,018 A * 8/1994 Maudal ..... 405/52
5,829,917 A 11/1998 Maudal ..... 405/52

* cited by examiner

*Primary Examiner*—Frederick L. Lagman
(74) *Attorney, Agent, or Firm*—Law Office of Timothy E. Siegel; Timothy E. Siegel

(57) ABSTRACT

A muted tidal regulator adapted to be interposed between a tidal body of water and an inland area at least partially isolated from the tidal body of water by a physical barrier. The assembly includes a tide gate that is made up of a conduit connecting said tidal body of water to said inland area and a closure operable to selectively prevent water flow through the conduit. The assembly also includes an inland water level sensing device and a closure control assembly responsive to the sensing device and adapted to affirmatively permit water flow through the conduit when the sensing device senses an inland water level below a threshold.

10 Claims, 2 Drawing Sheets

MUTED TIDAL REGULATOR

BACKGROUND OF THE INVENTION

Estuaries and connected tidal marshes play a critical role in aiding the survival of juvenile salmonid and other aquatic creatures by providing a productive feeding area that is protected from marine predators and a transitional zone for gradual acclimation to salt water. Unfortunately, a tide gate is likely to be installed at the mouth of an estuary to prevent tidal flooding of low lying coastal areas. A tide gate, which prevents the flow of ocean water into the estuary or tidal marsh, destroys the habitat's value to salmonids & other auquatic life by decreasing salinity and dissolved oxygen and increasing the temperature range of the remaining water. In addition, a tide gate disrupts the movement of fish from the ocean into the estuary or other inland water body.

If one were to simply remove the tide gates, however, many structures that had been built since the tide gates' installation would be destroyed. Moreover, agricultural and other developed areas would face a harmful intrusion of salt water. Nevertheless, entry of ocean water into a coastal area could be permitted if the entry was restricted to a level that avoided harm to structures and farms. Unfortunately, heretofore there has been no practical way of accomplishing this goal.

SUMMARY OF THE INVENTION

In a first separate aspect, the present invention is a muted tidal regulator adapted to be interposed between a tidal body of water and an inland area at least partially isolated from the tidal body of water by a physical barrier. The assembly includes a tide gate that is made up of a conduit connecting the tidal body of water to the inland area and a closure operable to selectively prevent water flow through the conduit. The assembly also includes an inland water level sensing device and a closure control assembly responsive to the sensing device and adapted to affirmatively permit water flow through the conduit when the sensing device senses an inland water level below a threshold.

In a second separate aspect, the present invention is a method of restoring the intertidal quality of a coastal inland area that has been blocked from the ocean by a barrier. The method includes permitting water to flow from the ocean to the coastal inland area whenever the water level in the coastal inland area falls below a threshold. Water is also permitted to flow from the coastal inland area to the ocean whenever the water level of the coastal inland area exceeds the water level of the ocean immediately adjacent to the coastal inland area.

The foregoing and other objectives, features and advantages of the invention will be more readily understood upon consideration of the following detailed description of the preferred embodiment(s), taken in conjunction with the accompanying drawings.

DETAILED DESCRIPTION OF THE PREFERRED EMBODIMENT(S)

Figure 1:
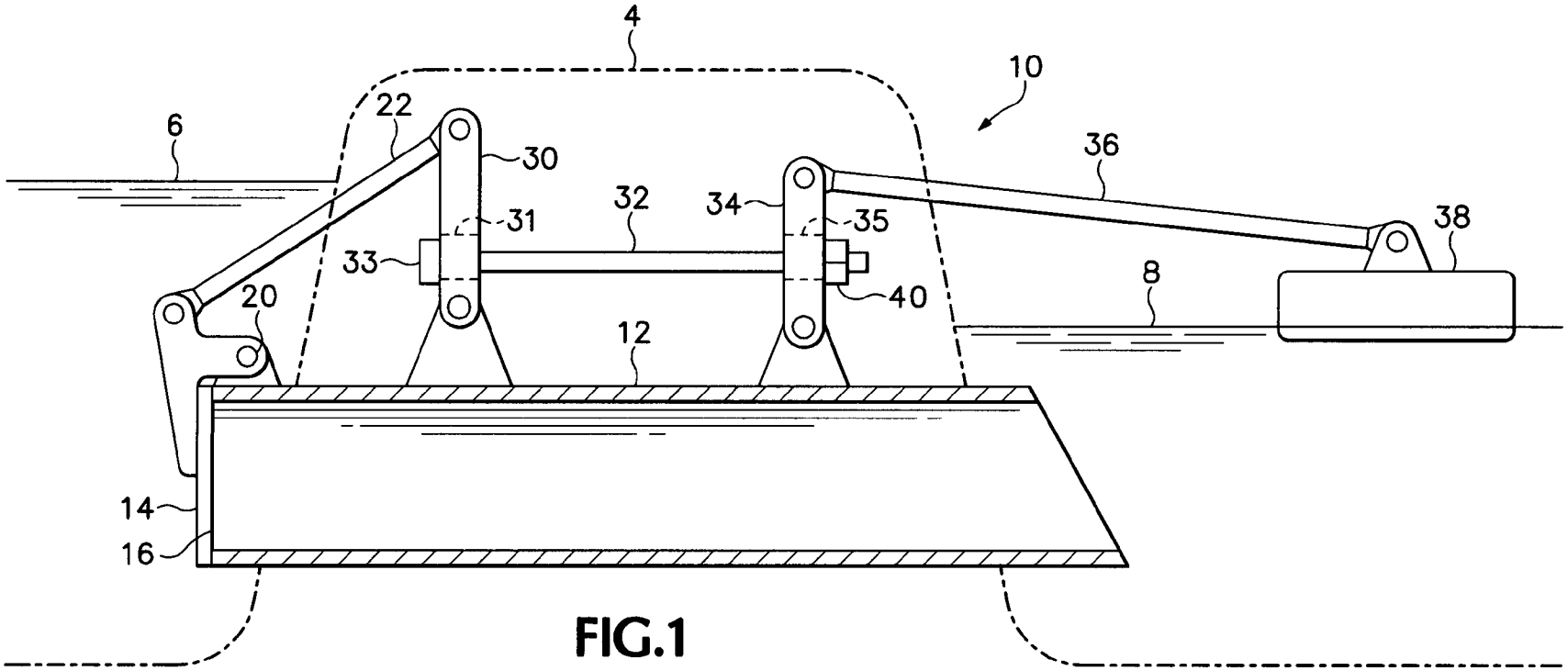
FIG. 1 is a side sectional view of a muted tidal regulator according to the present invention, in a closed state.
Figure 2:
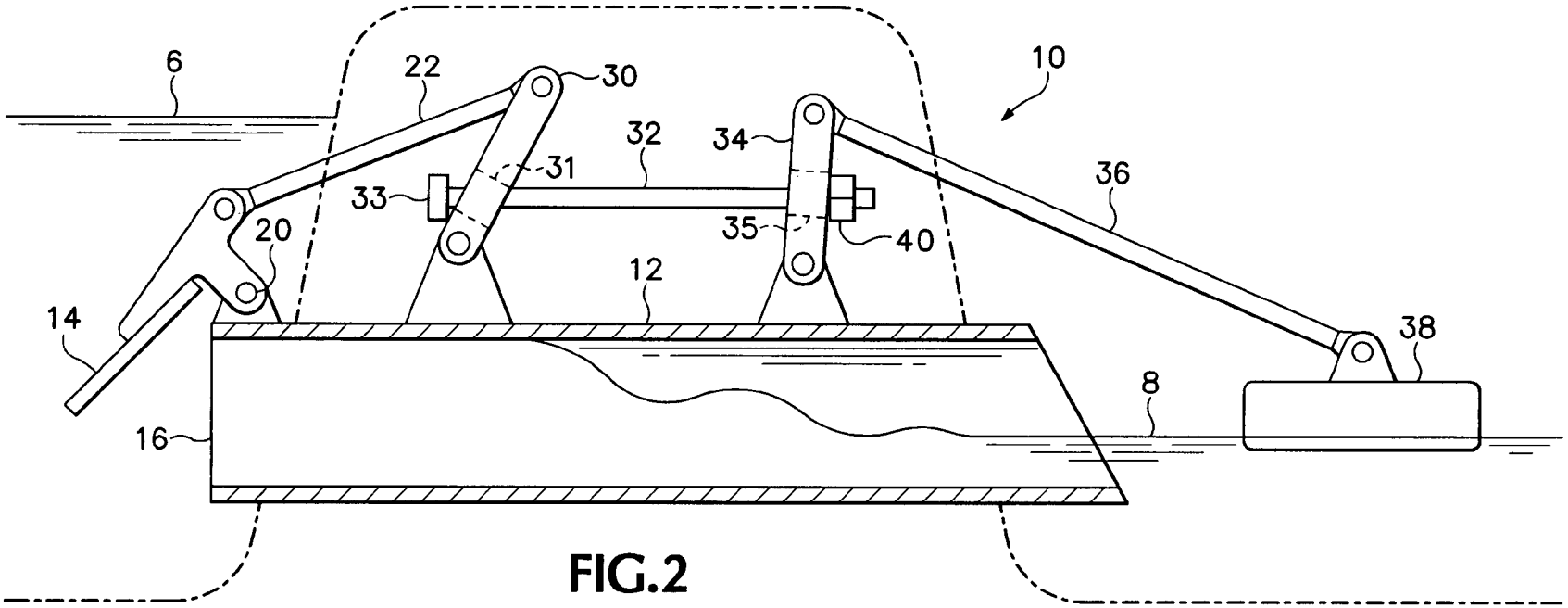
FIG. 2 is a side sectional view of the muted tidal regulator of FIG. 1, in an open state.

In one preferred embodiment a muted tidal regulator 10 is placed between an ocean 6, or other tidal water body, and an estuary 8, or other inland water body, that are separated by a levee 4. Muted tidal regulator 10 includes a conduit 12, connecting water bodies 6 and 8. At the tidal or ocean side of conduit 12 there is a closure 14 seated on an outer rim 16 of conduit 12.

As closure 14 is generally top mounted, it will have the tendency, similar to the closure of a standard tide gate, to swing shut to prevent ocean water from entering the estuary 8. Unlike other tide gates, however, closure 14 can be prevented from closing by a further mechanism as will be explained. Closure 14 is mounted by a hinge 20 that is rotatably mounted to the top of the conduit 12. Hinge 20 is also flexibly mounted to closure 14, so that some rotation is permitted, to facilitate the proper seating of closure 14 on rim 16. Taken together, closure 14, rim 16 and hinge 20 form a tide gate.

Hinge 20 is shaped with an upward portion that is rotatably mounted to a gate rod 22. As will be explained below, gate rod 22 pulls closure 14 open when the water level in the estuary 8 is below a threshold level. This permits the water of ocean 6 to pour through conduit 12 (given that the tide is high enough in ocean 6) until the level of estuary 8 is above a threshold level, at which point gate rod 22 is permitted to travel downwardly, permitting closure 14 to close.

To achieve this object, gate rod 22 is hinged to a gate rocker arm 30 that can be pulled backwardly (toward estuary 8) by a pull rod 32. Pull rod 32 extends through an opening 31 in rocker arm 30 and is retained there by an enlarged end 33. Accordingly, pull rod 32 can pull, but cannot push, rocker arm 30. Pull rod 32 is in turn connected to a float rocker arm 34 by extending in an aperture 35. As a result, pull rod 32 is pulled by rocker arm 34, when arm 34 is pulled toward estuary 8 by a float rod 36 that is hinged to a float 38. Float 38 pulls float rod 36 toward estuary 8 when the water level of estuary 8 is low. This, in turn, pulls float rocker arm 34, which pulls pull rod 32, which pulls gate rocker arm 30, thereby pulling gate rod 22, which pulls hinge 20, which pulls open closure 14, allowing water from ocean 6 to pour through conduit 12, if the tide is high enough. When the level of estuary 8 is high, closure 14 is unrestrained, because as noted, pull rod 32 only pulls and cannot push rocker arm 30. Accordingly, at any time the level of estuary 8 is higher than the level of ocean 6, water can drain from the estuary 8 into the ocean 6.

The advantages of assembly 10 should now be apparent. Fresh water is permitted to empty out of estuary 8, whenever the water level in estuary 8 is higher than the water level of ocean 6. In this manner, assembly 10 performs the normal, draining function of a tide gate. Controlled tidal flooding of inland areas around estuary 8 is also allowed, more closely approximating the natural state of estuary 8. This controlled tidal flooding helps to prevent water temperature from rising to a level that is deadly to young fish and maintains the salinity and other water quality parameters of estuary 8 in a range that can be tolerated by juvenile salmonids and other aquatic life. Moreover, the adjustment mechanism 40 permits the maximum tidal flooding level to be set at a level that will not damage buildings or farm or pasture land.

The maximum distance between the float rocker arm 34 and the gate rocker arm 30 can be set by a length adjustment mechanism 40 on pull rod 32. This, in turn, sets the threshold below which, if the water in body 8 descends, closure 14 will be pulled open.

Figure 3:
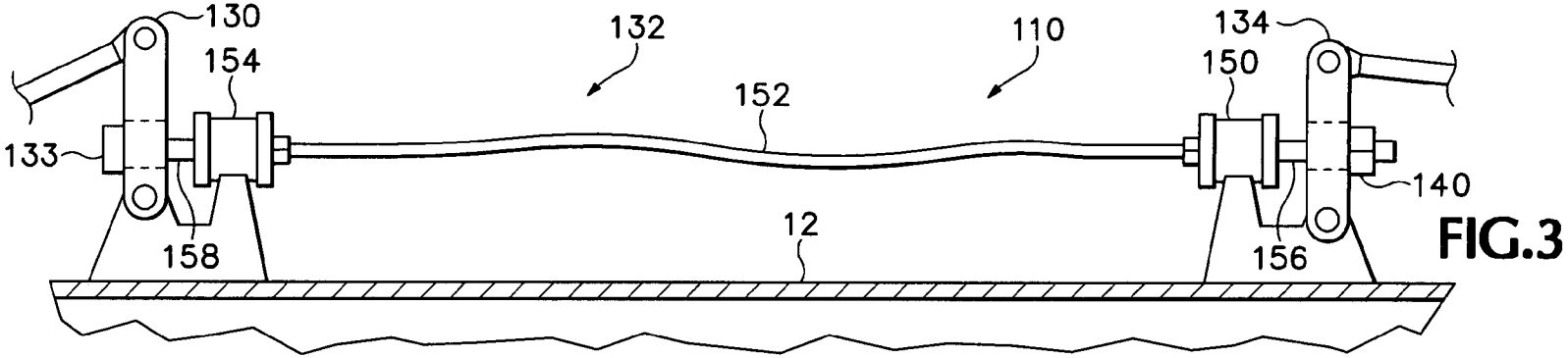
FIG. 3 is a side sectional view of a muted tidal regulator according to an alternative embodiment of the present invention.

Referring to FIG. 3, in an alternative preferred embodiment of a muted tidal regulator 110 (partial view) a hydraulic linkage is used, rather than a purely mechanical linkage. The parts of assembly 110 that are not shown may be exactly the same as the like portions of assembly 10. In assembly 110, the pull rod 32 of assembly 10 is replaced by a hydraulic assembly 132, which includes a pair of hydraulic cylinders 150 and 154, connected by a hydraulic tube 152. Pistons 156 and 158, which cooperate with cylinders 150 and 154 respectively, are engaged with rocker arms 134 and 130, respectively, in the same manner that pull rod 32 is engaged with rocker arms 34 and 30. An adjustment 140 may be used in the same manner as adjustment element 40. In another alternative preferred embodiment piston 158 links as a pull rod directly to the top of closure 14.

The terms and expressions that have been employed in the foregoing specification are used as terms of description and not of limitation. There is no intention, in the use of such terms and expressions, of excluding equivalents of the features shown and described or portions thereof, it being recognized that the scope of the invention is defined and limited only by the claims which follow. Specifically, although the tide gate or closure 14 shown is top hinged, it would also be possible to use, for example, a side hinged closure.

What is claimed is:

1. A muted tidal regulator adapted to be interposed between a tidal body of water and an inland area at least partially isolated from said tidal body of water by a physical barrier, said assembly comprising:

(a) a tide gate, including:

(i) a conduit connecting said tidal body of water to said inland area;

(ii) a closure operable to selectively prevent water flow through said conduit;

(b) an inland water level sensing device;

(c) a closure control assembly responsive to said sensing device and adapted to affirmatively permit water flow through said conduit when said sensing device senses an inland water level below a threshold.

2. The muted tidal regulator of claim 1 wherein water is always permitted to flow through said conduit from said inland area to said tidal body of water whenever the water level is higher in said inland area than in said tidal body of water.

3. The muted tidal regulator of claim 1 wherein said threshold is user selectable.

4. The muted tidal regulator of claim 1 wherein said sensing assembly includes a float, permitted to float in said inland area or in a portion of said conduit proximal to said inland area.

5. The muted tidal regulator of claim 4 wherein said closure control assembly is a mechanical linkage, linking said float to said closure.

6. The muted tidal regulator of claim 4 wherein said closure control assembly is a fluid pressure actuator assembly, having a first chamber a pressurized fluid conduit and a fluid pressure actuator, and wherein a change in vertical float position results in a change in pressure in said first chamber, which is communicated by way of said pressurized fluid conduit to said fluid pressure actuator, and wherein a downward change in position by said float results in said fluid pressure actuator placing said closure into an open state.

7. The muted tidal regulator of claim 6 wherein said fluid pressure actuator assembly is a hydraulic assembly.

8. The muted tidal regulator of claim 6 wherein said fluid pressure actuator assembly is a pneumatic or hydraulic assembly.

9. A method of restoring the intertidal quality of a coastal inland area that has been blocked from the a tidal body of water by a barrier, comprising:

(a) permitting water to flow from said tidal body of water to said coastal inland area whenever the water level in said coastal inland area falls below a threshold; and (b) permitting water to flow from said coastal inland area to said tidal body of water whenever the water level of said coastal inland area exceeds the water level of the tidal body of water immediately adjacent to said coastal inland area.

10. The method of claim 9 wherein said step of permitting water to flow from said tidal body of water to said coastal inland area further includes permitting fish to move from said tidal body of water to said coastal inland area.

* * * * *